US006413167B1

(12) United States Patent
Burke

(10) Patent No.: US 6,413,167 B1
(45) **Date of Patent: *Jul. 2, 2002**

(54) GOLF OVERSWING ALERTING MECHANISM AND GOLF CLUB WITH OVERSWING ALERTING MECHANISM

(76) Inventor: Thomas J. Burke, 5 Matheson Rd., Whitehouse Station, NJ (US) 08889

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/436,582

(22) Filed: Nov. 9, 1999

Related U.S. Application Data

(63) Continuation-in-part of application No. 09/133,236, filed on Aug. 13, 1998, now Pat. No. 6,012,988.

(51) Int. Cl.[7] ..... A63B 57/00; A63B 69/36; A63B 53/06; A63B 53/16

(52) U.S. Cl. ..... 473/224; 473/202; 473/219; 473/221; 473/234

(58) Field of Search ..... 473/202, 221, 473/219, 223, 224, 231–234

(56) References Cited

U.S. PATENT DOCUMENTS 4,898,389 A * 2/1990 Plutt ..... 273/186 A
5,082,283 A * 1/1992 Conley et al. ..... 273/186 A
5,184,826 A * 2/1993 Hall, Jr. ..... 273/186.2
5,419,562 A * 5/1995 Cromarty ..... 273/183
5,435,561 A * 7/1995 Conley ..... 273/186.2
6,012,988 A * 1/2000 Burke ..... 473/224
6,196,932 B1 * 3/2001 Marsh et al. ..... 473/223

* cited by examiner

*Primary Examiner*—Paul T. Sewell
*Assistant Examiner*—Sneh Varma
(74) *Attorney, Agent, or Firm*—Frommer Lawrence & Haug LLP; Matthew K. Ryan; Bruno Polito

(57) ABSTRACT

A golf overswing alerting mechanism is provided which produces a visual and/or audible indicator for the purpose of alerting a golfer to an improper swinging movement of a golf club. The overswing alerting mechanism is housed entirely within the hollow opening of the golf club shaft or is accommodated in a housing that is detachably affixed to the golf club. In a preferred configuration, the alerting mechanism includes a sound generation assembly for generating an audible sound upon occurrence of the overswing condition; an energy generation member to provide electrical energy to the sound generation assembly, and a circuit closing member or accelerometer(s) detecting the occurrence of an overswing condition. The preferred mechanism further includes an LCD readout provided in the grip butt of the golf club grip which indicates to the golfer the speed of the golf club shaft.

11 Claims, 4 Drawing Sheets

GOLF OVERSWING ALERTING MECHANISM AND GOLF CLUB WITH OVERSWING ALERTING MECHANISM

CROSS-REFERENCE TO RELATED APPLICATIONS

This application is a continuation-in-part application to U.S. patent appln. Ser. No. 09/133,236, filed Aug. 13, 1998, now U.S. Pat. No. 6,012,988.

FIELD OF THE INVENTION

The present invention relates to the field of aids for assisting a golfer in obtaining a proper swinging movement of a golf club, and more particularly, relates to an overswinging alerting mechanism for a golf club or golf club practice aid which generates a visual and/or audible indicator for the purpose of alerting the golfer to an improper swinging movement of the golf club.

BACKGROUND OF THE INVENTION

In the past, various devices have been employed to indicate an improper swinging movement of a golf club so that hopefully a golfer can perfect his swing. For instance, in U.S. Pat. No. 1,549,350 to Deike issued Aug. 11, 1925, a whistle is either secured within a recess of the golf club head (see FIG. 4 of Deike) or extended from the top of the golf club head (see FIG. 5 of Deike). This whistle produces the loudest sound at the point of greatest speed of the golf club, which Deike contends should occur at the time of contact of the golf club head with the golf ball. It has been found, however, that the proper golf swing is not necessarily purely dependent upon striking the golf ball at the maximum speed of the golf club.

In U.S. Pat. No. 4,283,057 to Ragan issued Aug. 11, 1981, a golf club is provided with an air flow hole through its head which contains a whistle which according to Ragan provides an indication of the smoothness and velocity of the swing based upon the turbulence of the ambient air at the air flow hole's outlet head. However, due to variables which determine air turbulence, such as wind gusts, etc., it has been found desirable to provide an overswing alerting mechanism which is not dependent upon the air turbulence of the ambient air.

Moreover, since the whistle in Ragan is provided in an air flow hole in the golf club head, the Ragan golf club can only be utilized as a golf practice device unless the Ragan club head employs a second whistle 6 which is provided in hole 12 and the first hole 4 and whistle 5 are eliminated as is shown in FIG. 5 of Ragan. In this embodiment, Ragan contends that sound output may be adequate in some instances if the upper end of the shaft is left open to provide an adequate flow of pressurized air. However, Ragan concedes that this golf club swing trainer will only provide a sound output that may be adequate in some instances, particularly when the golf club is swung in the absence of excessive background noise. However, in view of the many conditions in which golf is played, it has been found desirable to provide an overswing alerting mechanism which is not dependent upon the presence or absence of background noise.

In U.S. Pat. No. 3,730,530 to Oka et al. issued May 1, 1973, a golf swing training attachment is attached by a suction disk to the golf club head wherein a vibration plate emits a sound when the club head reaches a desirable speed. However, in view of the speed of swing of the golf club, such attachments have been found to fly off the golf club. Therefore, it has been found desirable to provide an overswing alerting mechanism for a golf club which is permanently mounted on or incorporated within a golf club, or which is detachably affixed to the club so as to provide an overswing alert without flying off the club during a swing.

In U.S. Pat. No. 3,776,556 to McLaughlin issued Dec. 4, 1973, an attachment is externally mounted on the golf club shaft which includes a pair of differently oriented and pitched whistles which McLaughlin contends do not emit a sound when the swing of the golf club is perpendicular to the club face but will emit differing sounds when there is a hook or a slice. However, the generation of sounds from the two whistles is only dependent upon the angle of the golf club face with respect to the intended swinging direction of the golf club. Accordingly, the McLaughlin golf club practice aid does not produce an audible sound merely upon the occurrence of an overswing condition.

Moreover, the United States Golf Association ("USGA") promulgates and administers the Rules of Golf in the United States. It is believed that each of the golf club practice devices mentioned above does not comply with at least one of the USGA's rules relating to improper equipment. For instance, the USGA Rules of Golf provide that, in general, the club must not have any external attachments (see USGA Rules of Golf 1998–1999, §4-1a). Therefore, it is believed that the golf club practice aids of U.S. Pat. Nos. 3,730,530, 3,776,556 and the aid of FIG. 6 of U.S. Pat. No. 1,549,350 do not comply with at least this USGA Rule. In addition, the USGA Rules of Golf provide that the club head cannot have holes therethrough as it must be generally plain in shape (see USGA Rules of Golf 1998–1999 §4-1d and App. II, §4-1d). Therefore, it is believed the golf club practice aids of U.S. Pat. No. 4,283,057 and the aid of FIGS. 1–4 of U.S. Pat. No. 1,549,350 do not comply with at least this USGA Rule. Under the USGA Rules of Golf, penalties, such as penalty strokes, etc., result from use of improper equipment. It has therefore been found desirable to provide an overswing alerting mechanism for a golf club which is believed to be in compliance with the current USGA Rules of Golf.

OBJECTS OF THE INVENTION

Therefore, it has been found desirable to provide an overswing alerting mechanism for a golf club which avoids the aforementioned disadvantages of the prior art.

An additional object of the present invention is to provide a golf club with overswing alerting mechanism which generates a visual and/or audible indicator for the purpose of alerting a golfer to an improper swinging movement of the golf club.

Another object of the present invention is to provide an overswing alerting mechanism which is not purely dependent upon the speed at which the golf ball is struck by the golf club.

A further object of the present invention is to provide an overswing alerting mechanism for a golf club which is not dependent upon the air turbulence of the ambient air to generate an audible sound upon the occurrence of an improper swinging condition.

Still another object of the present invention is to provide an overswing alerting mechanism for a golf club which is reliable in producing an audible sound upon the occurrence of an overswing condition regardless of the presence or absence of background noise.

An additional object of the invention is to provide an overswing alerting mechanism for a golf club which is permanently incorporated within the golf club or is detachably affixed to the golf club.

A further object of the present invention is to provide a golf club with overswing alerting mechanism which is believed to be in compliance with the current USGA Rules of Golf.

A still further object of the present invention is to provide a golf club with an overswing alerting mechanism which incorporates a digital read for indicating the speed at which a player swings the club. The indication may represent the actual speed of some portion of the club (e.g. the club shaft), the relative speed of a club portion from swing to swing without regard to any actual speed, or may merely represent how hard a player is swinging without reference to the speed of any club portion (e.g. a representation of how fast a players arms are moving during a swing).

Another object of the invention is to provide an overswing alerting mechanism which is equipped for transfer of swing information to an external memory and/or processor.

Through use of the present invention a golfer's swing speed can be assessed and a correct swing speed for the golfer can be determined. By swinging at the determined speed the golfer is more likely properly execute the swing, returning the club face to the ball square on the downswing and avoiding poor shots (e.g. "slices", "hooks", "worm burners" and "pop ups").

Various other objects, advantages and features of the present invention will become readily apparent from the ensuing detailed description and the novel features will be particularly pointed out in the appended claims.

SUMMARY OF THE INVENTION

In accordance with the present invention, a golf club with an overswing alerting mechanism is provided which produces an audible sound upon occurrence of an overswing condition. As is typical, this golf club includes a golf club shaft having a hollow opening extending therethrough and a golf club head supported on an end of the golf club shaft with the golf club head having a striking face for hitting the golf ball.

In accordance with one of the general objects of the present invention, the overswing alerting mechanism disclosed herein can be permanently incorporated within the golf club of the present invention. More particularly, the overswing alerting mechanism of the present invention is housed entirely within the hollow opening of the golf club shaft. This overswing alerting mechanism includes a sound generation assembly for generating an audible sound upon occurrence of the overswing condition. In a preferred embodiment, this sound generation assembly is in the form of a horn provided within the hollow opening of the golf club shaft. The sound of the horn can be heard through the standard opening provided in the grip butt of the golf club grip.

In order to provide electrical energy to the sound generation assembly, an energy generation member is electrically connected thereto and supported within the hollow opening of the golf club shaft. In a preferred embodiment, the energy generation member is in the form of two 1½ volt hearing aid batteries.

In order to activate the energy generation member only upon the occurrence of an overswing condition, the overswing alerting mechanism for the golf club of the present invention includes a circuit activating or closing member provided in the hollow opening of the golf club shaft. In one embodiment, this circuit closing member includes a weight member which upon the occurrence of an overswing condition closes a contact member which in turn impinges upon a contact adjustment screw/switch to complete an electrical circuit such that an audible sound is generated by the sound generation assembly. More particularly, the weight member and the contact member are positioned within the hollow opening of the golf club shaft so that the weight member will only close the contact member if the golf club is overswung.

In another preferred embodiment, the circuit closing member includes an electronic transducer which is electrically connected between the energy generation member and the sound generation assembly. Upon sensing an overswing condition of the golf club, the electronic transducer completes an electrical circuit such that an audible sound is generated by the sound generation assembly.

Moreover, an LCD readout can be provided in the grip butt of the golf club which indicates to the golfer the speed of the golf club shaft.

Accordingly, a preferred embodiment of a golf club with overswing alerting mechanism has been designed which is believed to be in compliance with the current Rules of Golf of the United States Golf Association as the overswing alerting mechanism is not externally attached, as it is entirely housed within the hollow opening of the golf club shaft, and in addition, the club head remains plain in shape (i.e., with no holes therethrough).

In an alternative embodiment of the invention the overswing alerting mechanism accommodated within a housing which is capable of being detachably affixed to a golf club. In this manner the mechanism may be attached to a golfer's club as a practice aid and detached from the club when the golfer is playing a round.

Further, in a preferred embodiment of the invention the overswing mechanism includes one or more accelerometers for the purpose of detecting overswing conditions. The data from the accelerometers may be processed and/or stored in a processing unit internal to the mechanism, and may be passed from the internal processing unit to a second processing unit, external to the mechanism, for further processing and/or long term storage.

BRIEF DESCRIPTION OF THE DRAWINGS

The following detailed description, given by way of example, will best be understood in conjunction with the accompanying drawing in which.

DETAILED DESCRIPTION OF CERTAIN PREFERRED EMBODIMENTS OF THE INVENTION

Figure 1:
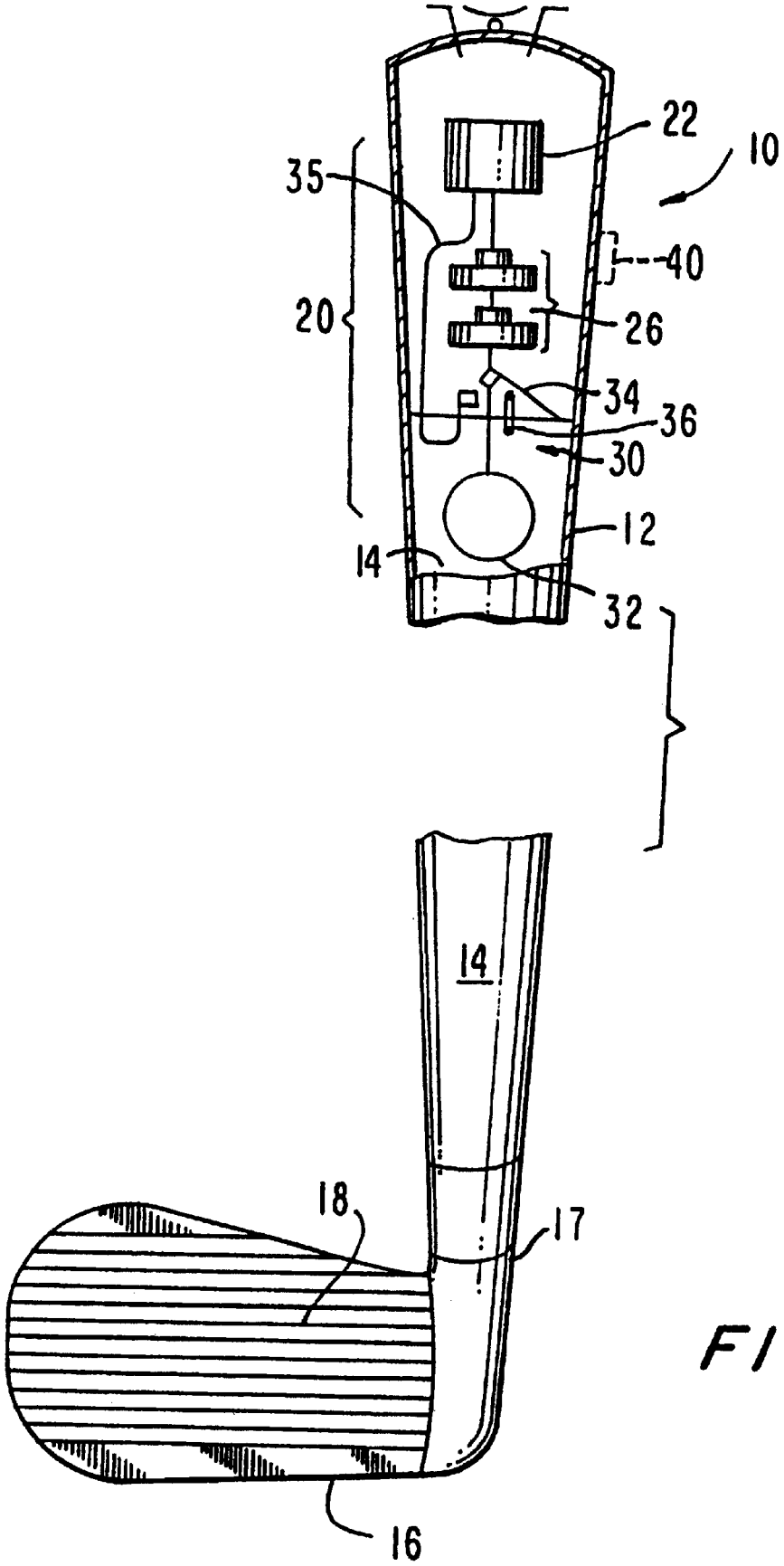
FIG. 1 is a front elevational view in cross-section of a preferred embodiment of a golf club with overswing alerting mechanism in accordance with the teachings of the present invention.

Referring now to the drawings, there is illustrated a preferred embodiment of a golf club having an overswing alerting mechanism in accordance with the present invention. As is described below, this golf club with overswing alerting mechanism produces an audible sound upon the occurrence of an overswing condition of the golf club.

As is shown in FIG. 1, the golf club 10 of the present invention generally includes a golf club shaft 12 having a hollow opening 14 extending therethrough for the length thereof and a golf club head 16 supported on an end 17 of the golf club shaft 12 with the golf club head 16 having a striking face 18 for hitting the golf ball.

Figure 3:
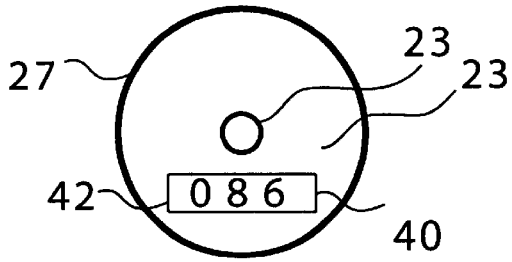
FIG. 3 is a top view of the grip butt with LCD readout which can be incorporated in the golf club with overswing alerting mechanism of FIGS. 1 and 2.

In order to alert the golfer that the golf club has been overswung, an overswing alerting mechanism, generally referred to by reference numeral 20 in FIG. 1, is permanently incorporated within the golf club 10 of the present invention. In order to prevent the overswing alerting mechanism 20 from altering the golfer's swing, the overswing alerting mechanism 20 of the present invention is housed entirely within the hollow opening 14 of the golf club shaft 12. As is shown in FIG. 3, the sound of the horn can be heard through the standard central opening 23 provided in the grip butt 25 of the grip 27 fit over the top end of the golf club shaft 12.

As is shown in FIG. 1, the overswing alerting mechanism 20 includes a sound generation assembly 22 for generating an audible sound upon the occurrence of an overswing condition. In the preferred embodiment, the sound generation assembly 22 is in the form of a horn but it can be any electrically-operated device which can emit an audible sound. As is shown in FIG. 1, the sound generation assembly 22 is sized to fit within the hollow opening 14 of the golf club shaft 12.

In order to provide electrical energy to the sound generation assembly 22, an energy generation member 26 is electrically connected thereto and supported within the hollow opening 14 of the golf club shaft 12. In the preferred embodiment, the energy generation member 26 is in the form of two 1½ volt hearing aid batteries. However, any power supply which can be sized to be accommodated within the hollow opening 14 of the golf club shaft 12 and still provide sufficient electrical power to the sound generation assembly 22 may be employed.

As is shown in FIG. 1, the overswing alerting mechanism 20 for a golf club of the present invention also includes a circuit activating or closing member 30 provided in the hollow opening 14 of the golf club shaft 12 which activates the energy generation member 26 only upon the occurrence of an overswing condition. More particularly, this circuit closing member 30 includes a weight member 32 which, upon the occurrence of an overswing condition, closes a contact member 34, which in turn, contacts a contact adjustment screw/switch 36 which is electrically connected to the sound generation assembly 22 by means of electrical wiring 35. Accordingly, the electrical circuit between the energy generation member 26 and the sound generation assembly 22 is closed to thereby generate an audible sound from the sound generation assembly 22. As shown in FIG. 1, the weight member 32 and contact member 34 are positioned within the hollow opening 14 of the golf club shaft 12 so that the weight member 32 will only close the contact member 34, and thus close the electrical circuit between the energy generation assembly 26 and the sound generation assembly 22, if the golf club is overswung.

Figure 2:
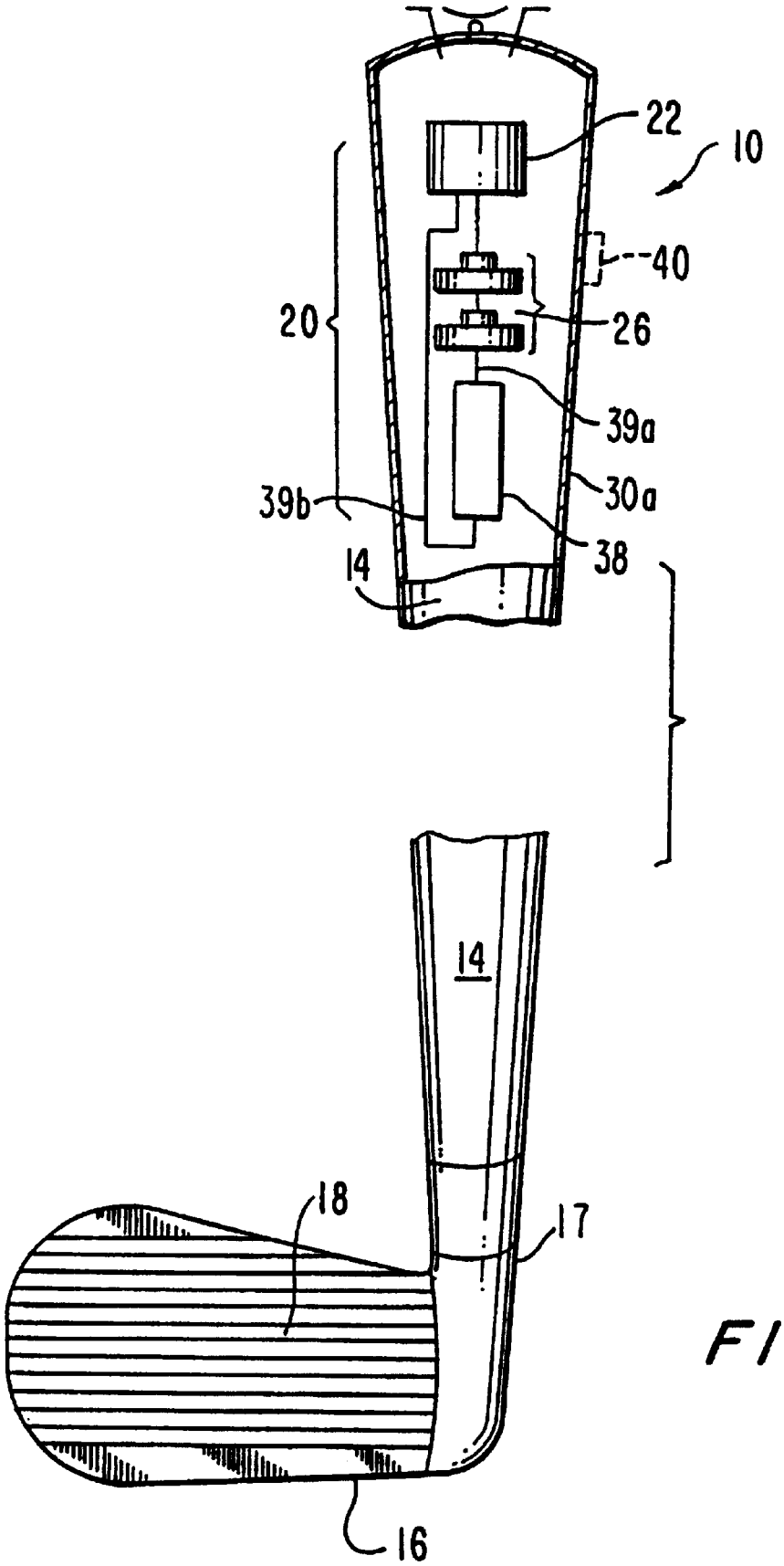
FIG. 2 is a front elevational view in cross-section of another preferred embodiment of a golf club with overswing alerting mechanism in accordance with the teachings of the present invention.

Another preferred embodiment of the circuit closing member for the overswing alerting mechanism for a golf club of the present invention is shown in FIG. 2. In this embodiment, the circuit closing member 30*a* includes an electronic transducer 38 which is electrically connected between the energy generation member 26 and the sound generation assembly 22 by means of electrical wiring 39*a* and *b*. Upon sensing an overswing condition of the golf club, the electronic transducer 38 closes the electrical circuit such that an audible sound is generated by the sound generating assembly 22.

In a further embodiment of the present invention, as is shown in FIG. 3, an LCD readout 40 can be provided in a recess 42 of the grip butt end 23. This recess 42 extends appropriately ¼"×½" inwardly from the top end of the grip butt end 23. The LCD readout 40 indicates in miles per hour the speed of the golf club shaft.

Figure 4:
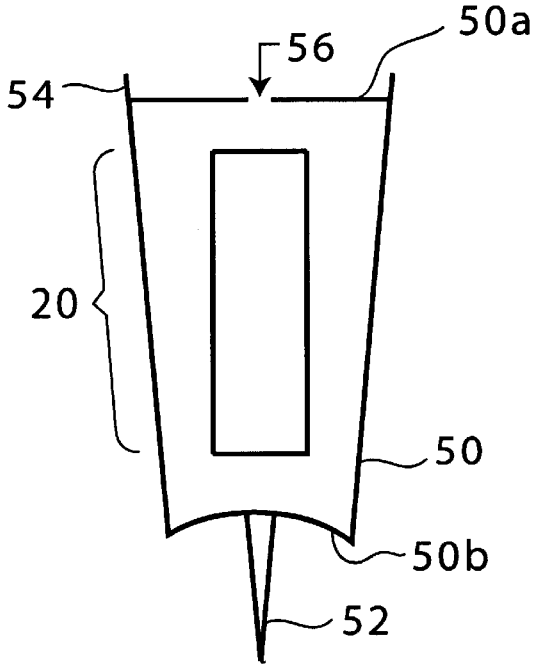
FIG. 4 is a cross-section view of an alternative embodiment of a golf club with overswing alerting mechanism in accordance with the teachings of the present invention.
Figure 5:
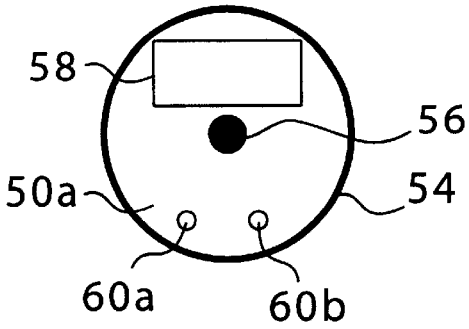
FIG. 5 is a top view of the alerting mechanism housing depicted in FIG. 4.

An alternative embodiment of the invention is shown in FIGS. 4 and 5. As can be seen from FIG. 4, in the alternative embodiment, the overswing alerting mechanism 20 is positioned within a housing 50 that may be generally cylindrical or conical in shape—although it is not limited to such shapes. The housing includes two "end surfaces" 50*a* and 50*b*, end surface 50*a* having a through hole 56, and end surface 50*b* being fixed to a projection 52. The through hole 56 is provided for allowing sound projected by the overswing mechanism's sound generation unit (element 22 in FIGS. 1 and 2) to exit the housing uninhibited. Projection 52 is provided for detachably attaching the housing to the butt end of a golf club. That is, the projection is inserted into a standard central opening of a grip butt like the opening 23 and butt 25 described in relation to FIGS. 1–3.

Further, as can be noted from FIG. 4, end surface 50*b* is concave in shape in order to more securely adjoin the butt end of a golf club, and end surface 50*a* includes a protective lip 54 projecting upward from the surface.

FIG. 5 shows the outside of the housing of FIG. 4 as viewed by looking down on surface 50*a*. As can be seen from FIG. 5, surface 50*a* is generally circular in shape, and therefore lip 54 which runs along the perimeter of the surface is also generally circular in shape. As further shown, a display 58 and buttons 60*a* and 60*b* are positioned within surface 50*a*. The lip, which projects approximately ⅛' above surface 50*a*, is provided primarily to protect display 58 and buttons 60*a*, 60*b* from direct impact with the ground and other objects. The display is used, for example, to display a golfer's swing speed, while the buttons may be respectively used, for example, to turn the mechanism on and off and to set the swing speed at which the alarm should be activated. Some alternative uses of the display and buttons are described below with respect to FIG. 6.

Figure 6:
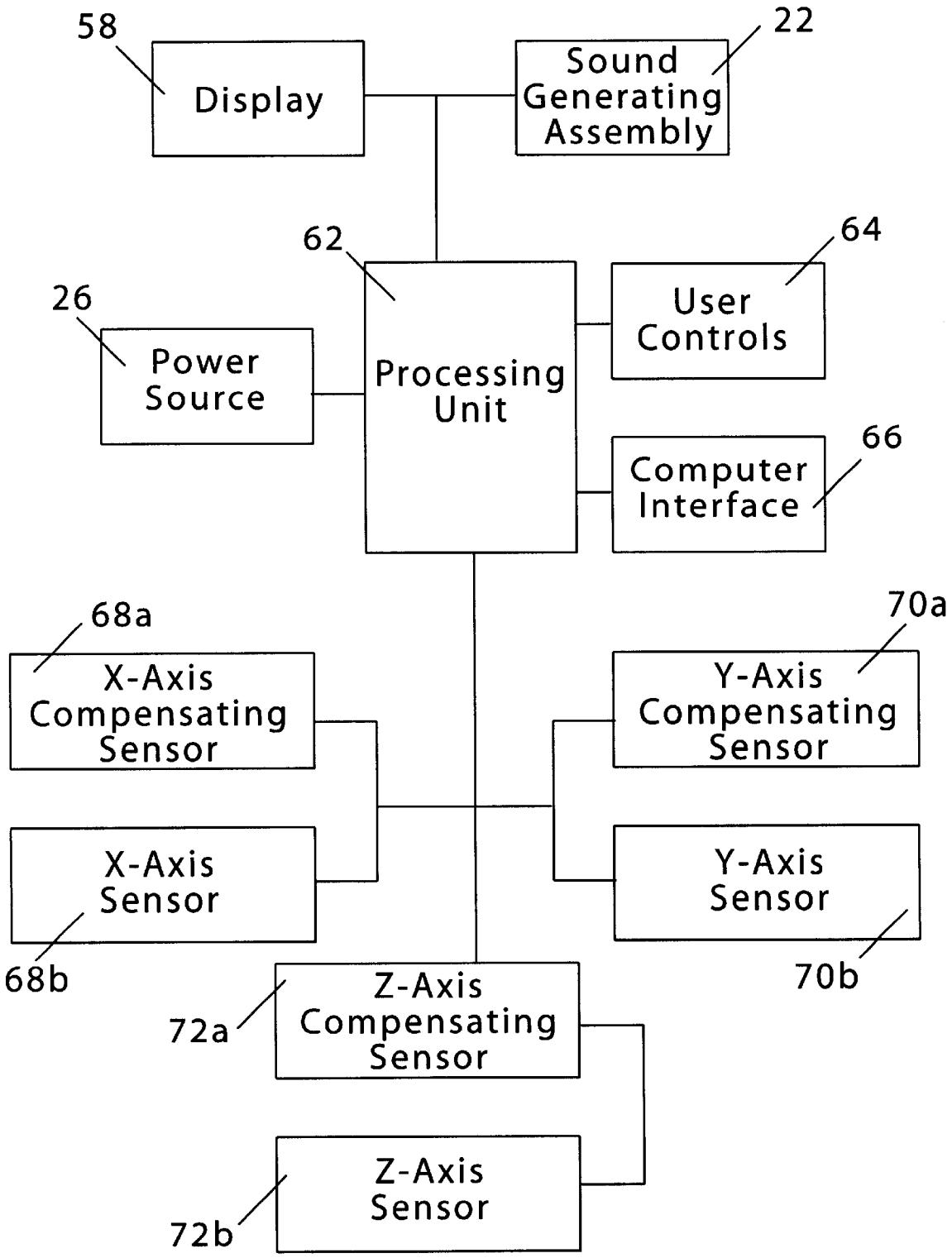
FIG. 6 is a block diagram representation of a preferred embodiment of the alerting mechanism of the invention.

FIG. 6 is a block diagram representation of a preferred embodiment of the alerting mechanism of the invention. The alerting mechanism of FIG. 6 includes a multiple of sensors 68*a*, 68*b*, 70*a*, 70*b*, 72*a* and 72*b* and a processing unit 72, in addition to the previously described power source 26, sound generation assembly 22 and display 58. A set of user controls 64 and a computer interface are also included, the user controls referring, for example, to buttons 60*a* and 60*b* of FIG. 5, and the computer interface being provided for coupling of the mechanism to an external computer/processor.

Each sensor of FIG. 6 is capable of measuring force applied to the alerting mechanism along a particular axis. Thus, for example, sensor 68*a* is an accelerometer which measures the force applied to the mechanism along the X-axis of the three dimensional reference system. Similarly sensors 70*a* and 72*a* may be accelerometers which respectively measure Y-axis and Z-axis forces. In one possible application, sensors 68*a*, 70*a* and 70*b* operate to measure three-dimensional force components acting on the mechanism during a golf swing and pass the measurements to the processing unit which derives an indication of the swing speed from the measurements. It should be noted, however, that the use of three sensors is not required for generation of a swing speed indication. Any one of the sensors 68*a*–72*b*, or any combination of the sensors 68*a*–72*b*, can be used to provide a swing speed indication. Of course, the number of sensors which can be used is not limited to six.

Regardless of the number of sensors employed, the data from the sensors is processed and/or stored in the processing unit 62. In the configuration depicted in FIG. 6, two sensors are employed for each axis of motion and processing the data from each axis involves a differential calculation. That is, in order to convert axial g-forces to actual club head speed, one must employ two sensors per axis and measure the differential g-force on the sensors.

In any event, the data processed/stored in the processor can be used to generate an indicator of club head speed suitable for viewing on display 58 and/or suitable for triggering the alarm of the sound generating assembly 22. Furthermore, the processing unit may be coupled to a computer via computer interface 66 so that sensor data stored in the processing unit can be downloaded to the computer for further analysis. For example, data from sensors 68*a*–72*b* may be used by a computer to construct a graphical representation of a golfer's entire swing.

Based upon the foregoing, it will be appreciated that the golf club with overswing alerting mechanism of the present invention generates an audible sound upon occurrence of an overswing condition. Moreover, the generation of the audible sound of the overswing alerting mechanism of the present invention is not purely dependent upon the speed at which the golf ball is struck by the golf club as instead an audible sound is generated if the golf club is overswung.

Further, since the overswing alerting mechanism of the present invention is not in the form of a whistle, it is not dependent upon the air turbulence of the ambient air.

Moreover, it is believed that the preferred embodiments of a golf club with overswing alerting mechanism of the present invention set forth above comply with the current USGA Rules of Golf relating to golf equipment. That is, in order to make the golf club with overswing alerting mechanism of the present invention suitable for both practice and play, the mechanism is permanently incorporated within the golf club. In this regard, the mechanism is not externally attached, as it is entirely housed within the hollow opening 14 of the golf club shaft, and in addition, the club head remains generally plain in shape (i.e., it requires no holes through the club head). Alternatively, the overswing alerting mechanism is accommodated within a housing that can be detachably affixed to a golf club so that the mechanism can be attached to the club during practice and detached during play under USGA rules.

In a further embodiment, as shown in the dotted line in FIG. 1, an on-off switch 40 can be attached to the golf club shaft 12 for activating and deactivating the overswing alerting mechanism 20 when desired.

In still another embodiment, one or more accelerometers are included within the alerting mechanism 20, the data from these accelerometers being used to provide overswing indication and being downloadable to a processor and/or memory external to the mechanism.

While the present invention has been particularly shown and described with reference to certain preferred embodiments, it will be readily apparent to those of ordinary skill in the art that various changes and modifications may be made therein without departing from the sprit and scope of the invention. It is intended that the appended claims be interpreted as including the foregoing as well as various other such changes and modifications.

What is claimed is:

1. A golf club with an overswing alerting mechanism comprising:

a golf club shaft having a head end and a grip butt end;

a golf club head supported on said head end of said golf club shaft with said golf club head having a striking face for hitting a golf ball; and means for alerting the user as to an overswing condition of the golf club head with said overswing alerting means being accommodated within a housing which is detachably affixed to a grip butt fixed to said grip butt end of said shaft; and means for numerically indicating the swing speed of the golf club shaft;

whereby said housing is detachably affixed to said grip butt by inserting a rigid elongated member through said grip butt such that said member is substantially parallel to the axis of said shaft.

2. The golf club of claim 1 wherein the overswing alerting means includes sound generation means for generating a sound upon occurrence of the overswing condition.

3. The golf club of claim 2 wherein said sound generation means includes a horn.

4. The golf club of claim 2 wherein said overswing alerting means includes energy means for providing electrical energy to said sound generation means.

5. The golf club of claim 4 wherein said energy means is a pair of 1½ volt batteries.

6. The golf club of claim 4 wherein said overswing alerting means includes circuit closing means for electrically connecting said energy means with said sound generating means.

7. The golf club of claim 6 wherein said circuit closing means includes a weight member which upon the occurrence of the overswing condition closes a contact member impinges upon a contact adjustment screw/switch which completes an electrical circuit between said energy means and said sound generation means to thereby generate a sound from said sound generation means.

8. The golf club of claim 6, wherein said circuit closing means includes an electronic transducer which upon sensing an overswing condition completes an electrical circuit between said energy means and said sound generation means to thereby generate a sound from said sound generation means.

9. The golf club of claim 1, further comprising an on-off switch attached to said housing for activating and deactivating said overswing alerting means when desired.

10. The golf club of claim 1 wherein said swing speed indicating means is in the form of an LCD readout provided in a recess of said housing.

11. The golf club of claim 1, wherein said means for indicating the swing speed comprises:

at least one accelerometer; and a processing unit.

* * * * *